US011517784B2

(12) United States Patent
Heckman

(10) Patent No.: US 11,517,784 B2
(45) Date of Patent: Dec. 6, 2022

(54) MODULAR KETTLE-SHAPED DUMBBELL

(71) Applicant: Andrew MacKenzie Heckman, Annapolis, MD (US)

(72) Inventor: Andrew MacKenzie Heckman, Annapolis, MD (US)

( * ) Notice: Subject to any disclaimer, the term of this patent is extended or adjusted under 35 U.S.C. 154(b) by 0 days.

(21) Appl. No.: 17/241,575

(22) Filed: Apr. 27, 2021

(65) Prior Publication Data

US 2022/0339485 A1 Oct. 27, 2022

(51) Int. Cl.

| | |
|---|---|
| ***A63B 21/075*** | (2006.01) |
| ***A63B 21/00*** | (2006.01) |
| ***A63B 21/072*** | (2006.01) |

(52) U.S. Cl.

CPC ..... *A63B 21/075* (2013.01); *A63B 21/0726* (2013.01); *A63B 21/4035* (2015.10); *A63B 2209/08* (2013.01)

(58) Field of Classification Search

CPC ..... A63B 21/0726; A63B 21/075; A63B 21/4035; A63B 2209/08

See application file for complete search history.

(56) References Cited

U.S. PATENT DOCUMENTS

| | | | | |
|---|---|---|---|---|
| 8,128,537 | B2 * | 3/2012 | Signorile | A63B 21/0728 482/94 |
| 8,568,280 | B2 * | 10/2013 | Mendoza | A63B 21/0722 482/93 |
| 9,844,695 | B1 * | 12/2017 | Shorter | A63B 21/075 |
| 10,543,388 | B2 * | 1/2020 | Rachele | A63B 21/4019 |
| 2010/0331151 | A1 * | 12/2010 | Signorile | A63B 21/00196 482/93 |
| 2011/0275494 | A1 * | 11/2011 | Radi | A63B 21/0603 482/93 |
| 2012/0046148 | A1 * | 2/2012 | Aguila | A63B 23/03525 482/93 |
| 2016/0220887 | A1 * | 8/2016 | Lin | A63B 71/0054 |

* cited by examiner

*Primary Examiner* — Joshua Lee
(74) *Attorney, Agent, or Firm* — Whiteford, Taylor & Preston, LLP; Gregory M. Stone

(57) ABSTRACT

Disclosed herein is a modular kettle-bell shaped dumbbell having separate, equally weighted dumbbell portions that may optionally be used separately or may be temporarily joined together to form a single kettle-bell shaped dumbbell of twice the weight of the separate, equally weighted dumbbell portions. Each of the separate dumbbell portions may include one part of a two-piece connection system configured to temporarily lock the separate dumbbell portions to one another, with such connectors being configured such that upon achieving a fully engaged locking connection, the exteriors of each body portion of the first dumbbell portion and the second dumbbell portion together form a generally spherical main body portion and an upwardly extending handle having a generally circular cross-section throughout its length.

10 Claims, 3 Drawing Sheets

MODULAR KETTLE-SHAPED DUMBBELL

FIELD OF THE INVENTION

This invention relates generally to free weights, and more particularly to a modular, multi-piece kettle-shaped dumbbell that is adjustable in weight via reconfiguration of the separate elements of the dumbbell.

BACKGROUND OF THE INVENTION

Strength building exercises and general physical conditioning are popular and frequently employed methods of improving ones fitness, appearance, and self-confidence, and can help an individual to maintain a generally healthy lifestyle. Fitness enthusiasts often engage in weight training, including using various free weights to help to build both strength and endurance. When those efforts are successful, the weight trainer builds muscle mass, which over time makes a given amount of weight easier to lift and the related exercises using that weight easier to perform. In those cases, in order to continue build additional muscle mass and to maintain a high level of exertion during weight training exercises, it becomes necessary for the weight trainer to add more weight to keep up with that individual's increased strength and overall conditioning.

Dumbbells are frequently used in such weight training exercises. Conventional dumbbells typically comprise a singularly formed body having a fixed weight. Thus, gyms and individuals that weight train at home will often times have sets of dumbbells of varying weights that help them to engage in varied exercises and that allow them to increase weight as their conditioning improves and their bodies adjust to weights at each level. While effective in providing the weight trainer with a variety of lifting options, the sets of such weights often take up significant space and comprise a large number of separate pieces, and can carry significant expense in procuring and maintaining a full set.

Efforts have been made previously to provide weight-adjustable dumbbells, but such efforts often comprise complex connecting mechanisms with large numbers of parts that must be maintained by the user and that must at times proceed through a relatively complex reconfiguration process to adapt the assembly to the individual's current training goal.

Thus, there remains a need in the art for free weight configurations that are adjustable in weight to fit the user's current training needs, but that likewise are easier to use and manufacture than previously known weight-adjustable configurations.

SUMMARY OF THE INVENTION

Disclosed herein is a modular kettle-bell shaped dumbbell having separate, equally weighted dumbbell portions that may optionally be used separately or may be temporarily joined together to form a single kettle-bell shaped dumbbell of twice the weight of the separate, equally weighted dumbbell portions. Each of the separate dumbbell portions may include one part of a two-piece connection system configured to temporarily lock the separate dumbbell portions to one another, with such connectors being configured such that upon achieving a fully engaged locking connection, the exteriors of each body portion of the first dumbbell portion and the second dumbbell portion together form a generally spherical main body portion and an upwardly extending handle having a generally circular cross-section throughout its length.

In accordance with certain aspects of an embodiment of the invention, a modular kettle-shaped dumbbell is provided comprising a first body portion having a first weight and a first handle extending upward from the first body portion, the first body portion having at least one first body portion planar face, and a first element of a two-piece mating connector on the first body portion planar face; and a second body portion equal in weight to the first weight, the second body portion having a second handle extending upward from the second body portion, the second body portion having at least one second body portion planar face, and a second element of the two-piece mating connector on the second body portion planar face configured for removable attachment to the first element.

Still other aspects, features and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The numerous advantages of the present invention may be better understood by those skilled in the art by reference to the accompanying drawings in which.

DETAILED DESCRIPTION

The invention summarized above may be better understood by referring to the following description, claims, and accompanying drawings. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Descriptions of well-known functions and structures are omitted to enhance clarity and conciseness. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced items.

The use of the terms "first", "second", and the like does not imply any particular order, but they are included to identify individual elements. Moreover, the use of the terms first, second, etc. does not denote any order of importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Although some features may be described with respect to individual exemplary embodiments, aspects need not be limited thereto such that features from one or more exemplary embodiments may be combinable with other features from one or more exemplary embodiments.

Figure 1:
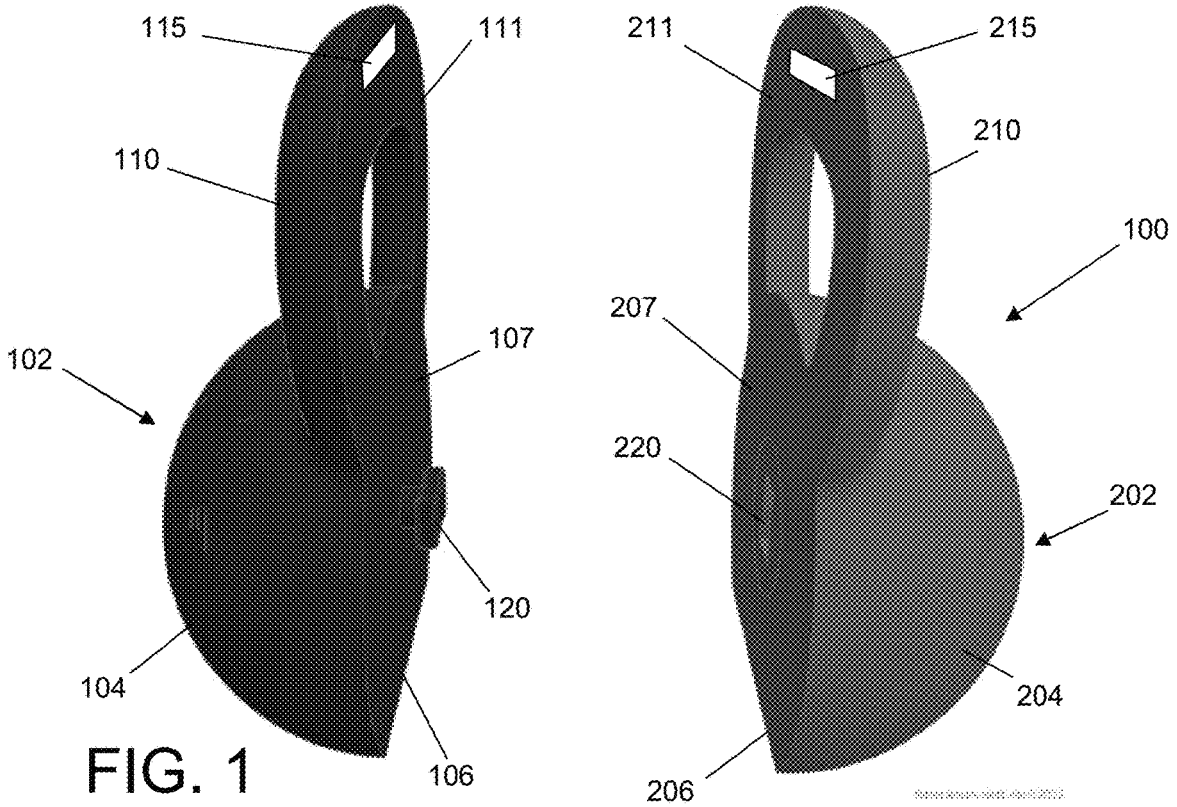
FIG. 1 is a side perspective view of a modular, kettle-shaped dumbbell in accordance with certain aspects of an embodiment of the invention.
Figure 2:
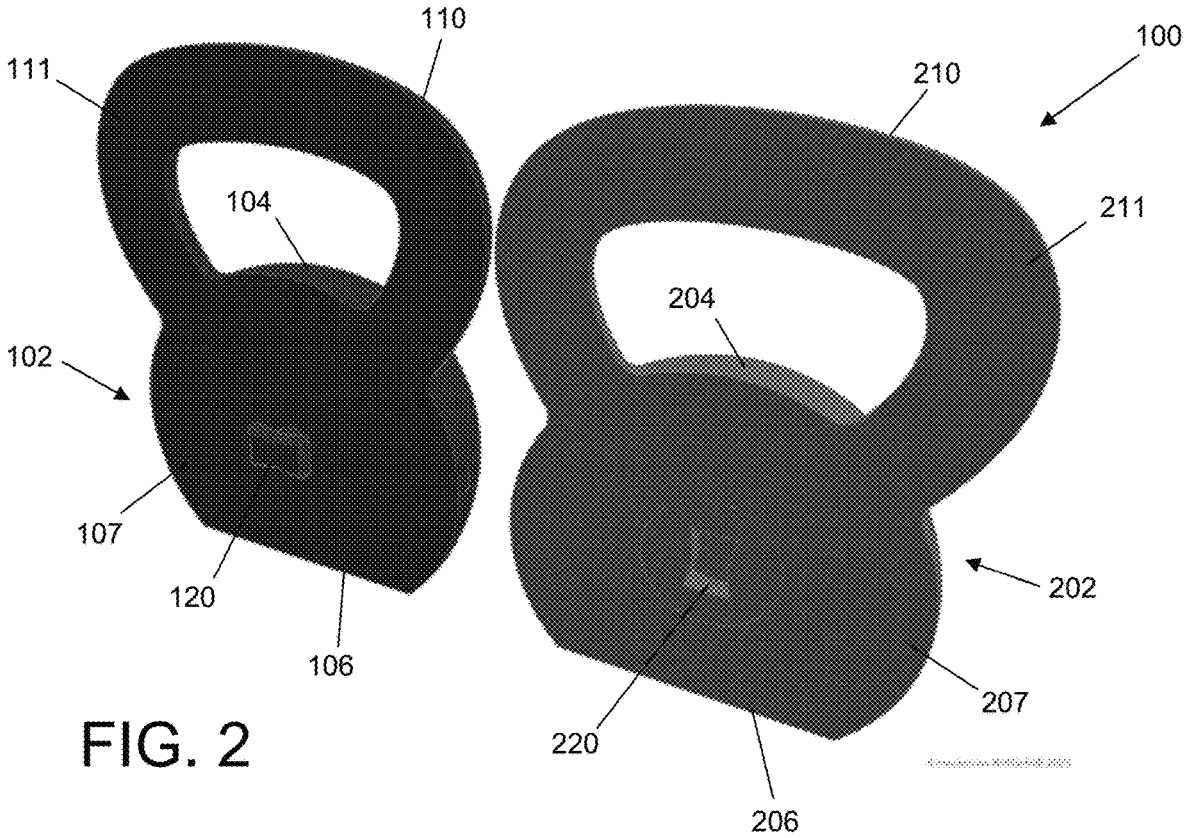
FIG. 2 is front perspective view of the modular, kettle-shaped dumbbell of FIG. 1.
Figure 3:
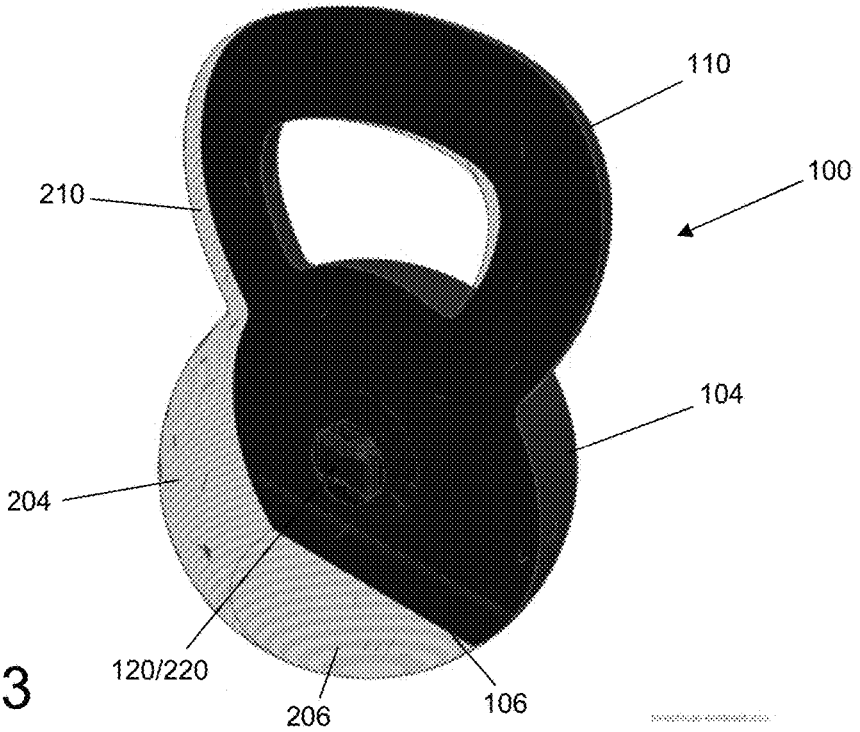
FIG. 3 is a front perspective view of the modular, kettle-shaped dumbbell of FIG. 1 in a connected configuration.

By way of summary and in accordance with certain aspects of an embodiment, a modular kettle-shaped dumbbell 100 is provided as shown in FIGS. 1-3, including a first dumbbell portion 102 and a second dumbbell portion 202.

First dumbbell portion 102 is of unitary, one-piece construction and has a generally semispherical main body portion 104, a flat bottom 106, and a handle 110. Semispherical main body portion 104 also includes a first flat face 107 that is perpendicular to flat bottom 106 and extends from flat bottom 106 to the top of semispherical main body portion 104. Likewise, handle 110 extends upward from the top of semispherical main body portion 104 and forms a loop that is joined to the semispherical main body portion 104 at two points, thus defining an open interior of handle 110 that allows a user to grip and lift first dumbbell portion 102. An interior face 111 of handle 110 defines a flat, planar surface that is parallel to and continuous with the plane defined by first flat face 107 of semispherical main body portion 104. A first part 120 of a two-piece connector is provided on first flat face 107 of semispherical main body portion 104, and is preferably centrally located within first flat face 107. For example, first part 120 of the two-piece connector may form a male engagement member of a male/female coupling that allows for the temporary joining first dumbbell portion 102 with second dumbbell portion 202, as discussed in greater detail below.

Likewise, second dumbbell portion 202 is of unitary, one-piece construction and has a generally semispherical main body portion 204, a flat bottom 206, and a handle 210. Semispherical main body portion 204 also includes a second flat face 207 that is perpendicular to flat bottom 206 and extends from flat bottom 206 to the top of semispherical main body portion 204. Likewise, handle 210 extends upward from the top of semispherical main body portion 204 and forms a loop that is joined to the semispherical main body portion 204 at two points, thus defining an open interior of handle 210 that allows a user to grip and lift second dumbbell portion 202. An interior face 211 of handle 210 defines a flat, planar surface that is parallel to and continuous with the plane defined by second flat face 207 of semispherical main body portion 204. A second part 220 of the two-piece connector is provided on second flat face 207 of semispherical main body portion 204, and is preferably centrally located within second flat face 207. For example, second part 220 of the two-piece connector may form a female engagement member of the male/female coupling referenced above that allows for the temporary joining of first dumbbell portion 202 with second dumbbell portion 202, as discussed in greater detail below.

In accordance with further aspects of an embodiment, first dumbbell portion 102 and second dumbbell portion 202 are identical in construction, other than the components 120 and 220 of the two-piece connector. Thus, each of first dumbbell portion 102 and second dumbbell portion 202 is of essentially equal weight. With this construction, a user may simultaneously exercise with both first dumbbell portion 102 and second dumbbell portion 202, with one in each hand, to provide an even workout on both sides of the user's body. However, when the user wishes to create additional strain during such exercise, first dumbbell portion 102 may be removably and temporarily joined to second dumbbell portion 202 by connecting first part 120 and second part 220 of the two-piece connector. When the first part 120 and second part 220 of the two-piece connector are fully engaged, first flat face 107 of first dumbbell portion 102 sits flush against second flat face 207 of second dumbbell portion 202, such that generally semispherical main body portions 104 and 204 form a generally spherical main body portion of a single kettle-shaped dumbbell, other than for the flat bottoms 106 and 206 (which likewise together form a single, planar flat bottom for the single kettle-shaped dumbbell). Likewise, when the first part 120 and second part 220 of the two-piece connector are fully engaged, interior face 111 of handle 110 sits flush against interior face 211 of second dumbbell portion 202, such that handles 110 and 210 together form a rounded handle of generally circular cross-section throughout the loop of handles 110 and 210.

Figure 4:
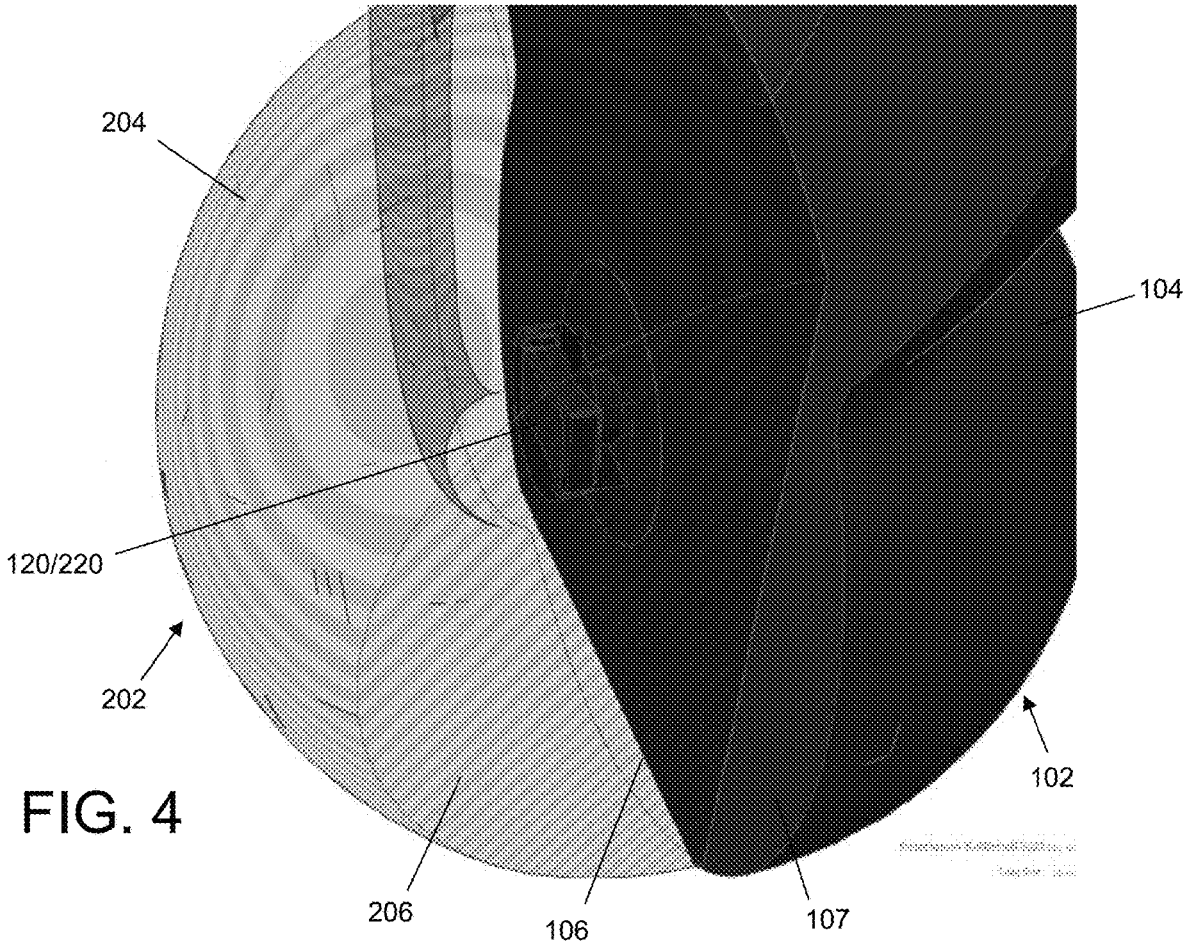
FIG. 4 is a side perspective view of the modular, kettle-shaped dumbbell of FIG. 1 showing an initial step of connecting the modular sections.

In accordance with still further aspects of an embodiment, first part 120 of the two-piece connector system may form a male element having an outer perimeter that, in a first orientation in which handle 110 and handle 210 are not aligned, will align with second part 220 of the two-piece connector system, which in turn may form a mating female element. Thus and as particularly shown in FIG. 4, when a user desires to use first dumbbell portion 102 and second dumbbell portion 202 together to form a single dumbbell unit, first dumbbell portion 102 may be positioned stationary in its flat bottom 106, and second dumbbell portion 202 may be situated, by way of non-limiting example, at 90° to first dumbbell portion 102 so as to align first part 120 of the two-piece connector with the opening of second part 220 of the two-piece connector. Once the two dumbbell portions 102 and 202 are brought together so that first flat face 107 is in contact with second flat face 207, male first part 120 of the two-piece connector will be fully engaged with female second part 220 of the two-piece connector. At this point, the two dumbbell portions 102 and 202 may be rotate in with respect to one another to bring their handles 110 and 210 into alignment so that interior face 111 of handle 110 likewise contacts and fully aligns with interior face 211 of handle 210. In this configuration, first dumbbell portion 102 is temporarily fixed to second dumbbell portion 202 such that the combined, modular assembly may then be used as a single kettle-shaped dumbbell that is twice the weight of each of first dumbbell portion 102 and second dumbbell section 202.

Optionally, to further enhance the connection and alignment between joined first dumbbell portion 102 and second dumbbell portion 202, as shown in FIG. 1 a first component 115 of a magnetic connector may be provided inset into interior face 111 of handle 110, and a second component 215 of such magnetic connector (having opposite polarity to that of first component 115) may be provided inset into interior face 211 of handle 210. Such magnetic connector may serve to provide further stability in the connected, combined assembly of first dumbbell portion 102 and second dumbbell portion 202.

Figure 5:
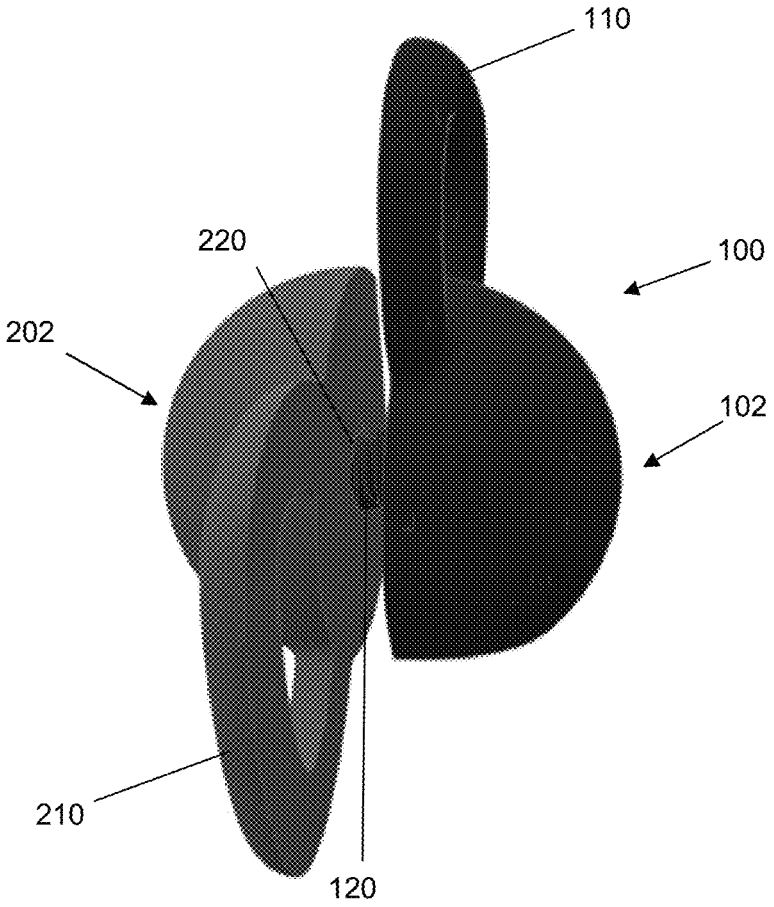
FIG. 5 is a side perspective view of a modular, kettle-shaped dumbbell in accordance with further aspects of an embodiment of the invention.

FIG. 5 likewise shows modular kettle-shaped dumbbell 100 with an alternate form of the two-piece connector, but otherwise identical in construction to the modular kettle-shaped dumbbell 100 of FIGS. 1-4. More particularly, first part 120 of the two-piece connector may form a threaded male component that may temporarily attach to a second part 220 forming a threaded receiver of the two-piece connector. Similarly, those skilled in the art will recognize that other connector configurations may be provided as first part 120 and second part 220 of the two-piece connector system, such as by way of non-limiting example a magnetic locking system, without departing from the spirit and scope of the invention.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A modular kettle-shaped dumbbell comprising:

a first body portion having a first weight and a first handle extending upward from said first body portion, said first body portion having at least one first body portion planar face, and a first element of a two-piece mating connector on said at least one first body portion planar face; and a second body portion equal in weight to said first weight, said second body portion having a second handle extending upward from said second body portion, said second body portion having at least one second body portion planar face, and a second element of said two-piece mating connector on said at least one second body portion planar face configured for removable attachment to said first element;

said first handle having a semi-circular cross-section throughout a length of said first handle, and said second handle having a semi-circular cross-section throughout a length of said second handle of identical configuration to said first handle;

wherein said first handle and said second handle together form a single handle having a circular cross-section when said first body portion is joined to said second body portion with said two-piece mating connector.

2. The modular kettle-shaped dumbbell of claim 1, wherein said first element is positioned centrally on said first body portion planar face, and said second element is positioned centrally on said second body portion planar face.

3. The modular kettle-shaped dumbbell of claim 2, wherein said first element and said second element together define a twist-lock connector.

4. The modular kettle-shaped dumbbell of claim 2, wherein said first element and said second element together define a threaded connector.

5. The modular kettle-shaped dumbbell of claim 1, further comprising a first magnetic member positioned in a planar face of said first handle.

6. The modular kettle-shaped dumbbell of claim 5, further comprising a second magnetic member positioned in a planar face of said second handle and having a magnetic polarity that is opposed to a magnetic polarity of said first magnetic member.

7. The modular kettle-shaped dumbbell of claim 6, wherein said first magnetic member is positioned to align with said second magnetic member when said first body portion is joined to said second body portion with said two-piece mating connector.

8. The modular kettle-shaped dumbbell of claim 1, said first body portion planar face having a first outer perimeter, and said second body portion planar face having a second outer perimeter matching said first outer perimeter.

9. The modular kettle-shaped dumbbell of claim 8, wherein said first body portion further defines a first semi-circular volume having a first flat bottom, and wherein said second body portion further defines a second semi-circular volume having a second flat bottom.

10. The modular kettle-shaped dumbbell of claim 9, wherein said first body portion and said second body portion together form a single body volume defining a spherical volume with a planar flat bottom when said first body portion is joined to said second body portion.

* * * * *